US005528111A

United States Patent [19]

Konopka et al.

[11] Patent Number: 5,528,111

[45] Date of Patent: Jun. 18, 1996

[54] BALLAST CIRCUIT FOR POWERING GAS DISCHARGE LAMP

[75] Inventors: John G. Konopka, Barrington; Kenneth D. Labudda, Buffalo Grove, both of Ill.

[73] Assignee: Motorola, Inc., Schaumburg, Ill.

[21] Appl. No.: 348,381

[22] Filed: Dec. 2, 1994

[51] Int. Cl.[6] ..... G05F 1/00

[52] U.S. Cl. ..... 315/291; 315/311; 315/209 R

[58] Field of Search ..... 315/307, 308, 315/209 R, 291 R, 311

[56] References Cited

U.S. PATENT DOCUMENTS 3,597,652 8/1971 Gates ..... 315/311

4,508,995 4/1985 Gajecki ..... 315/311

*Primary Examiner*—Frank Gonzalez
*Assistant Examiner*—Reginald A. Ratliff
*Attorney, Agent, or Firm*—J. Ray Wood

[57] ABSTRACT

A ballast for providing a dimmable fluorescent lamp (42) has a potentiometer (46) connected to AC power source (10). The potentiometer (46) is connected to a dimming circuit (44). In response to changes in the resistance of the potentiometer (46), dimming circuit (44) causes the duty cycle of a pulse width modulator (18) to change, thereby dimming the fluorescent lamp (42). A dimming disable circuit (60) disables the dimming circuit (44) when power is initially applied to the ballast (6) so that the lamp (42) will ignite.

7 Claims, 1 Drawing Sheet

BALLAST CIRCUIT FOR POWERING GAS DISCHARGE LAMP

BACKGROUND OF THE INVENTION

Fluorescent lamps (also known as gas discharge lamps) economically illuminate an area. Due to the unique operating characteristics of fluorescent lamps, the lamps must be powered by a ballast. Electronic ballasts provide a very efficient method of powering fluorescent lamps.

Generally, when power factor correction is required, an electronic ballast has a boost front-end for converting AC (alternating current) voltage from an AC power source into a DC (direct current) voltage which has a value greater than the peak voltage of the AC power source. An inverter then converts the DC into high frequency AC power.

It is highly desirable that the light level of the fluorescent lamps be adjustable. However, since the fluorescent lamps are energized by a ballast, designing a dimming circuit which provides adjustment of the light level is not straightforward.

Additionally, the dimming control itself is usually located remotely from the ballast. If the dimming control wires possess a potential different from that of the AC power lines, then the wires connecting the dimming control to the ballast must be routed through a conduit separate from the power lines, as required by Underwriters Laboratory. The requirement of a separate additional conduit makes installation of dimming ballasts very expensive.

DETAILED DESCRIPTION OF THE PREFERRED EMBODIMENT

Figure 1:
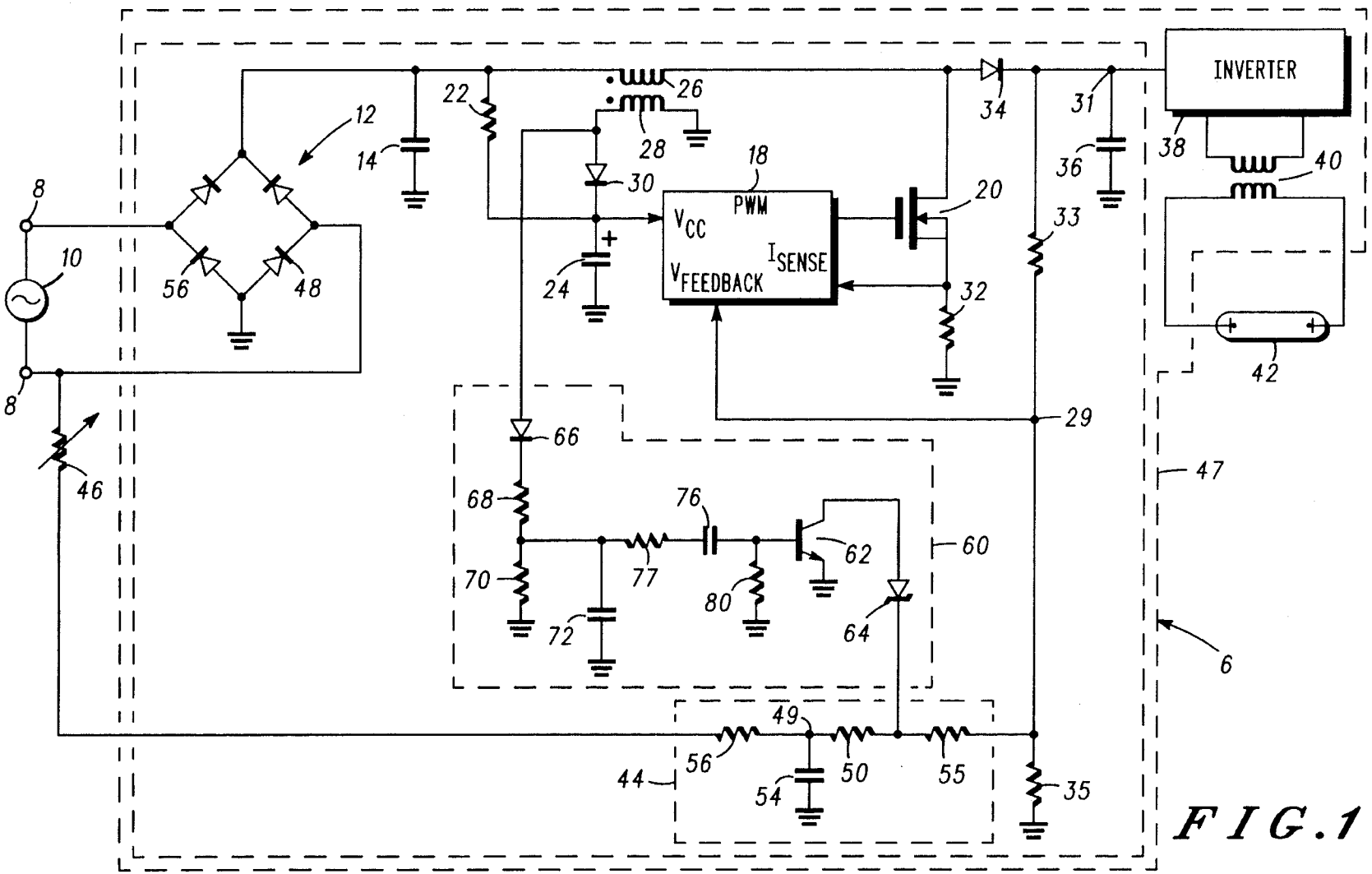
FIG. 1 is a diagram of the circuit of the present invention.

The ballast circuit described herein utilizes a potentiometer which controls the dimming function of the ballast. Because the potentiometer is coupled between one line of the AC power source and the circuit common of the ballast, only a single wire is required between the ballast and the dimming control. Additionally, because the dimming control is operated at the potential of the AC power lines, electrical isolation of the dimming control is not required.

FIG. 1 shows a ballast circuit 6. AC power source 10 is coupled to bridge rectifier 12 by way of a pair of AC input terminals 8. High frequency by-pass capacitor 14 provides a low impedance path to ground for high frequency current produced by operation of the boost 16.

In boost 16, pulse width modulator driver (PWM) 18 drives switch 20. PWM 18 could be an integrated circuit such as MC33262P. Resistor 22 charges capacitor 24 until the startup voltage of PWM 18 is reached. Boost inductor secondary winding 28 is coupled to capacitor 24 by way of diode 30. After initial startup of PWM 18, boost inductor secondary winding 28 supplies operating current for PWM 18. Capacitor 24 supplies filtered operating voltage for PWM 18. Boost inductor 26 operates in a known fashion, as is described in U.S. Pat. No. 5,191,263.

Resistor 32 provides a voltage signal proportional to the peak current flowing through boost inductor 26 and switch 20. The voltage signal is fed back to PWM 18 to control the pulse width of PWM 18. Resistor 32 thus forms a duty cycle control circuit for controlling the pulse width of PWM 18.

The DC voltage at DC rail 31 is determined by the duty cycle of PWM 18. The duty cycle of PWM 18 is determined by the requirement that the voltage at the junction 29 of resistors 33 and 35 equal the internal reference voltage of PWM 18. In order to maintain the voltage at junction 29 at the same level as the internal reference voltage, PWM 18 adjusts its duty cycle as needed.

Blocking diode 34 prevents bulk capacitor 36 from discharging through switch 20 when switch 20 is closed. Blocking diode 34 allows bulk capacitor 36 to receive energy from inductor 26 when switch 20 is open. Bulk capacitor 36 supplies filtered voltage to inverter 38. Inverter 38, by way of output transformer 40, supplies high frequency AC power to gas discharge lamp 42.

A variable light intensity (i.e., dimming) is accomplished by changing the voltage at DC rail 31. The voltage at DC rail is determined by the interaction of potentiometer 46, diode 56 of bridge rectifier 12, and dimming circuit 44. The DC junction voltage at junction 29 is a function of the voltage at junction 49 and the voltage at DC rail 31. PWM 18 monitors the voltage at junction 29 and adjusts the voltage at DC rail 31, by way of adjusting the duty cycle, so that the voltage at junction 29 equals the internal reference voltage of PWM 18.

Adjustment of potentiometer 46 causes a change in the voltage at junction 49. In response to a change in the voltage at junction 49, the voltage at junction 29, which is a function of the voltage at junction 49 and the voltage at DC rail 31, begins to change as well. PWM 18 detects the deviation in the voltage at junction 29 and compensates by changing the voltage at DC rail 31 such that the voltage at junction 29 becomes once again equal to the internal reference voltage of PWM 18. Therefore, adjustment of potentiometer 46 causes a change in the voltage at DC rail 31.

Due to the presence of diodes 48 and 56 in bridge rectifier 12, the voltage which is present between either line of AC power source 10 and ballast common is half-wave rectified AC and is the source of the voltage signal which potentiometer 46 provides to dimming circuit 44.

Adjustment of potentiometer 46 yields a variable filtered voltage at the junction 49 of first resistor 56, second resistor 50, and capacitor 54. First resistor 56 determines the maximum voltage which can be developed at junction 49 when potentiometer 46 is at its minimum resistance setting. Resistors 56, 50, 55 form a voltage divider network with potentiometer 46.

The series combination of second resistor 50 and third resistor 55 provides a path for the DC dimming signal present at junction 49 to reach PWM 18 while additionally minimizing the effect of capacitor 54 on the response time of the feedback signal developed at junction 29.

Potentiometer 46 is remotely located from ballast housing 47. (Potentiometer 46 could by any type of variable resistor). An advantage of the external connection of potentiometer 46 is that it allows dimming of fluorescent lamp 42 to be controlled from a convenient location, such as a wall switch box. Further, because the dimming circuit common is the same as the ballast circuit common, only a single wire in addition to the AC power wires is required in order to utilize the source of half-wave rectified AC power which exists between either line of the AC power source and ballast common. Since only a single wire is required, installation of the dimming circuit is simplified and less expensive.

Note that potentiometer 46 could be connected to either the neutral line or the hot line of AC power source 10.

Dimming disable circuit 60 disables the dimming circuit 44 by limiting the voltage present at the junction between resistors 50 and 55 for a predetermined period of time, which allows lamp 42 to properly ignite before it is dimmed.

Dimming is disabled whenever transistor switch 62 is on Zener diode 64 allows the collector of transistor 62 to draw current only as long as the voltage at the junction between resistors 50 and 55 equals, or attempts to exceed, the avalanche voltage of Zener diode 64.

Zener diode 64 is chosen so that the voltage at DC rail 31 does not become excessively high during ballast startup.

Diode 66, resistor 68, resistor 70, and capacitor 72 provide a filtered voltage for driving the base of transistor 62 after PWM 18 begins to operate.

After PWM 18 begins to operate, capacitor 76, which is initially uncharged, allows current to flow into the base of transistor 62, turning transistor 62 on. Transistor 62 remains on until capacitor 76 fully charges, at which time the current flowing into the base of transistor 62 ceases and transistor 62 turns off.

Resistors 78, 80, and capacitor 76 determine the amount of time for which the dimming disable circuit 60 is engaged when power is initially applied to the ballast.

Thus, dimming circuit 44 is not allowed to depress the voltage at DC rail 31 until well after lamp 42 has ignited.

Such a circuit provides for dimming of fluorescent lamp 42 while allowing the lamp to properly ignite prior to being dimmed.

We claim:

1. A ballast circuit for powering a gas discharge lamp at a variable light intensity from an AC power source comprising:

a pair of AC input terminals connected to the AC power source;

a driver contained in a housing, the driver coupled to the AC input terminals, the driver energizing the gas discharge lamp, the driver having a duty cycle, the duty cycle determining the light intensity;

the driver also having a duty cycle control circuit;

a variable resistor located remote from the housing having a resistance, the variable resistor connected to one AC input terminal and coupled to the duty cycle control circuit, the resistance of the variable resistor determining the duty cycle of the driver;

the variable resistor coupled to the driver by way of a network such that the network and the variable resistor form a voltage divider, the network located in the housing; and the network having a first resistor and a capacitor connected at a junction, the junction connected to the variable resistor.

2. The ballast circuit of claim 1 where the capacitor is also connected to a circuit common.

3. The ballast circuit of claim 2 where the junction has a DC junction voltage, and the DC junction voltage is determined by the resistance of the variable resistor.

4. The ballast circuit of claim 3 where the DC junction voltage is coupled to the duty cycle control circuit, such that the duty cycle is varied in response to the DC junction voltage.

5. The ballast circuit of claim 4 further comprising a dimming disable circuit for limiting the DC junction voltage for a predetermined period of time after the AC power source is first coupled to the circuit.

6. The ballast circuit of claim 5 where the dimming disable circuit includes a switch coupled between the junction and the circuit common.

7. The ballast circuit of claim 6 where the switch is temporarily closed when the AC power source is first coupled to the ballast circuit, and then opened after a predetermined period of time.

* * * * *